US011101553B2

(12) United States Patent
Adada et al.

(10) Patent No.: US 11,101,553 B2
(45) Date of Patent: Aug. 24, 2021

(54) ANTENNA SYSTEM WITH ACTIVE ARRAY ON TRACKING PEDESTAL

(71) Applicant: Sea Tel, Inc., Concord, CA (US)

(72) Inventors: Rami Adada, Walnut Creek, CA (US); Wei-Jung Guan, Walnut Creek, CA (US)

(73) Assignee: Sea Tel, Inc., Concord, CA (US)

( * ) Notice: Subject to any disclaimer, the term of this patent is extended or adjusted under 35 U.S.C. 154(b) by 78 days.

(21) Appl. No.: 16/263,805

(22) Filed: Jan. 31, 2019

(65) Prior Publication Data

US 2019/0280373 A1 Sep. 12, 2019

Related U.S. Application Data

(60) Provisional application No. 62/639,926, filed on Mar. 7, 2018.

(51) Int. Cl.

| | |
|---|---|
| ***H01Q 1/34*** | (2006.01) |
| ***H01Q 3/26*** | (2006.01) |
| ***H01Q 3/38*** | (2006.01) |
| ***H01Q 3/08*** | (2006.01) |
| ***H01Q 3/04*** | (2006.01) |

(52) U.S. Cl.

CPC ..... *H01Q 1/34* (2013.01); *H01Q 3/04* (2013.01); *H01Q 3/08* (2013.01); *H01Q 3/2652* (2013.01); *H01Q 3/385* (2013.01)

(58) Field of Classification Search

None

See application file for complete search history.

(56) References Cited

U.S. PATENT DOCUMENTS

| | | | | |
|---|---|---|---|---|
| 5,419,521 | A * | 5/1995 | Matthews | F16M 11/10 248/179.1 |
| 6,034,634 | A | 3/2000 | Karlsson et al. | |
| 6,151,496 | A * | 11/2000 | Richards | H01Q 3/08 455/428 |
| 6,310,582 | B1 | 10/2001 | Uetake et al. | |
| 6,642,889 | B1 | 11/2003 | McGrath | |
| 7,095,376 | B1 * | 8/2006 | Timothy | H01Q 1/125 343/705 |

(Continued)

OTHER PUBLICATIONS

Sultan et al., Elevation-Angle Variation of LEO Satellites over the Kingdom of Saudi Arabia, 2008, Arab Gulf Journal of Scientific Research, 26(2): pp. 145-151 (Year: 2008).*

*Primary Examiner* — Amy Cohen Johnson
*Assistant Examiner* — James H Cho
(74) *Attorney, Agent, or Firm* — Santa Fe IP, LLC

(57) ABSTRACT

A hybrid antenna having an active array on a tracking pedestal is configured to facilitate simultaneous multibeam operation with first and second satellites. The hybrid antenna system includes a pedestal having a base and a support pivotally mounted with respect to the base about a first axis, a one-dimensional active electronically scanned array (AESA) configured to scan along a scanning plane and rotatably mounted on the support about a skew axis, and a skew positioner configured to rotate the AESA about the skew axis for aligning the scanning plane with the first and second satellites to facilitate the simultaneous multibeam operation with the first and second satellites. A method of using the hybrid antenna having an active array on a tracking pedestal is also disclosed.

19 Claims, 8 Drawing Sheets

(56) References Cited

U.S. PATENT DOCUMENTS

| | | | | |
|---|---|---|---|---|
| 8,542,156 | B2 | 9/2013 | Patel | |
| 8,749,446 | B2 | 6/2014 | Manry, Jr. et al. | |
| 9,000,995 | B2 | 4/2015 | Blaney | |
| 9,466,889 | B2 | 10/2016 | Patel | |
| 9,882,261 | B2 | 1/2018 | Blaney | |
| 2015/0097743 | A1* | 4/2015 | Evans | H01Q 3/20 343/754 |
| 2016/0233588 | A1 | 8/2016 | Bily et al. | |

* cited by examiner

ANTENNA SYSTEM WITH ACTIVE ARRAY ON TRACKING PEDESTAL

CROSS-REFERENCES TO RELATED APPLICATIONS

This application claims priority to U.S. Provisional Patent Application No. 62/639,926 filed Mar. 7, 2018, the entire contents of which is incorporated herein by this reference.

BACKGROUND OF INVENTION

Field of Invention

This application relates, in general, to antenna systems having an active electronically scanned array (AESA) on a tracking pedestal, and more particularly to antenna systems having a one-dimensional AESA mounted on a tracking pedestal with skew positioning, along with methods for their use.

Description of Related Art

Satellite communications are increasingly relied upon. Early satellite communications relied upon geostationary earth orbit (GEO) satellites. As GEO satellites have a geosynchronous equatorial orbit, GEO satellites appeared fixed in the sky. Accordingly, an earth terminal communicating with a GEO satellite simply needed an antenna directed to the "fixed" GEO satellite to establish and maintain communications with the GEO satellite.

Constellations of medium earth orbit (MEO) satellites were later deployed, and more recently constellations of low earth orbit (LEO) satellites have been deployed. MEO satellites allowed for satellite communications with significantly reduced transmission delays and power requirements, and LEO satellites allowed for further reduced transmission delays and power requirements.

GEO satellites orbit the Earth at a height of 35,786 km (22,236 mi) above sea level and, as noted above, appear fixed in the sky. MEO satellites orbit below GEO satellites but higher than 2,000 km (1,200 mi) above sea level. Accordingly, MEO satellites have shorter orbital periods, ranging from about 2 hours to nearly 24 hours. LEO satellites orbit the Earth at an altitude of 2,000 km (1,200 mi) or less, and have even shorter orbital periods ranging from about 90 minutes to 2 hours.

Since MEO and LEO satellites do not appear fixed and instead follow an orbital path across the sky (as observed from an earth terminal), MEO and LEO satellites are only visible to the earth terminal for a finite period of time. Generally, MEO satellites are visible to a particular earth terminal for less than 8 hours. And with significantly shorter orbital periods, LEO satellites might be visible to a particular earth terminal for only 30 to 40 minutes.

In order to maintain continuous satellite communications with a satellite constellation, whether it is a MEO or LEO constellation, an earth terminal must track and maintain communications with a first satellite as it moves across the sky, and before the first satellite descends upon the horizon, the earth terminal must track and establish communications with a second satellite rising above the horizon. While both the first and second satellites are visible and being tracked, the earth terminal must "handoff" communications from the first satellite to the second satellite. Preferably the handoff is a "soft" handoff in which communications are established with the rising satellite before communications are broken with the descending satellite.

It is possible to perform soft handoffs with tracking dish antennas and/or with an active electronically scanned array (AESA). Generally, a pair of dish antennas are needed to perform a soft handoff—one to track and maintain communications with the first satellite, and another to establish communications with the second satellite before breaking communications with the first. However, manufacturing and installing two parabolic antennas comes with significant cost and footprint disincentives. And two-dimensional AESAs also come with significant cost and footprint disincentives.

Prior systems utilizing an AESA antenna mounted on two-axes antenna mounts are known. For example, U.S. Pat. No. 6,151,496 to Richards et al. discloses a system and method of performing soft handoff with a one-dimensional AESA. The Richards system includes a two-axes antenna mount that mechanically aligns the AESA in azimuth and roll. While the Richards system may allow for soft handoff between two satellites more efficiently than the dish antenna pairs and the two-dimensional AESAs described above, it appears that the handoff must occur while two satellites pass within an orthogonal scan plan (i.e., when the AESA is directed toward zenith), or while two satellites are at the same elevation angle within an oblique scan plan (i.e., when the AESA is directed away from zenith).

In light of the foregoing, it would therefore be useful to provide an antenna system that overcomes the above and other disadvantages of known tracking antennas.

BRIEF SUMMARY

One aspect of the present invention is directed to an antenna system configured to facilitate simultaneous multibeam operation with first and second satellites. The hybrid antenna system may include a pedestal including a base and a support pivotally mounted with respect to the base about a first axis, a one-dimensional active electronically scanned array (AESA) configured to scan along a scanning plane and rotatably mounted on the support about a skew axis, and a skew positioner configured to rotate the AESA about the skew axis for aligning the scanning plane with the first and second satellites to facilitate the simultaneous multibeam operation with the first and second satellites.

The pedestal may be a three-axes pedestal and the support may be an elevation frame. The pedestal may further include an azimuth frame rotatably mounted on the base to rotate about an azimuth axis, and a cross-level frame pivotally mounted on the azimuth frame to pivot about a cross-level axis. The elevation frame may support the tracking antenna and may be pivotally mounted on the cross-level frame to pivot about the elevation axis.

The three-axes pedestal may be configured for tracking Low Earth Orbit (LEO) communications satellites.

The base of the three-axes pedestal may be configured to be mounted upon a maritime vessel.

The pedestal may be a two-axes pedestal and the support may be a secondary mount. The pedestal may further include a primary mount pivotally mounted on the base to pivot about an X axis. The secondary mount may be pivotally mounted on the primary mount to pivot about a Y axis, the Y axis being orthogonal to the X axis.

The two-axes pedestal may be configured for tracking Low Earth Orbit (LEO) and/or Medium Earth Orbit (MEO) communications satellites.

The base of the two-axes pedestal may be configured to be mounted upon the ground.

The pedestal may be a two-axes pedestal. The pedestal may further include an azimuth frame rotatably mounted on the base to rotate about an azimuth axis. The support may be pivotally mounted on the azimuth frame to pivot about a roll axis, the roll axis being orthogonal to the azimuth axis.

The two-axes pedestal may be configured for tracking Low Earth Orbit (LEO) and/or Medium Earth Orbit (MEO) communications satellites.

The base of the two-axes pedestal may be configured to be mounted upon the ground.

The pedestal may be a single-axis pedestal and the first axis may be a declination axis configured to adjust the declination angle of the tracking antenna, wherein the support is pivotally mounted on the base about the declination angle.

The single-axis pedestal may be configured for tracking equatorial orbit Low Earth Orbit (LEO) and/or Medium Earth Orbit (MEO) communications satellites.

The base of the single-axis pedestal may be configured to be mounted upon the ground.

The skew positioner may be configured to rotate the AESA about the skew axis for aligning the scanning plane with the first and second satellites to facilitate a soft hand-off between the first and second satellites.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Figure 1:
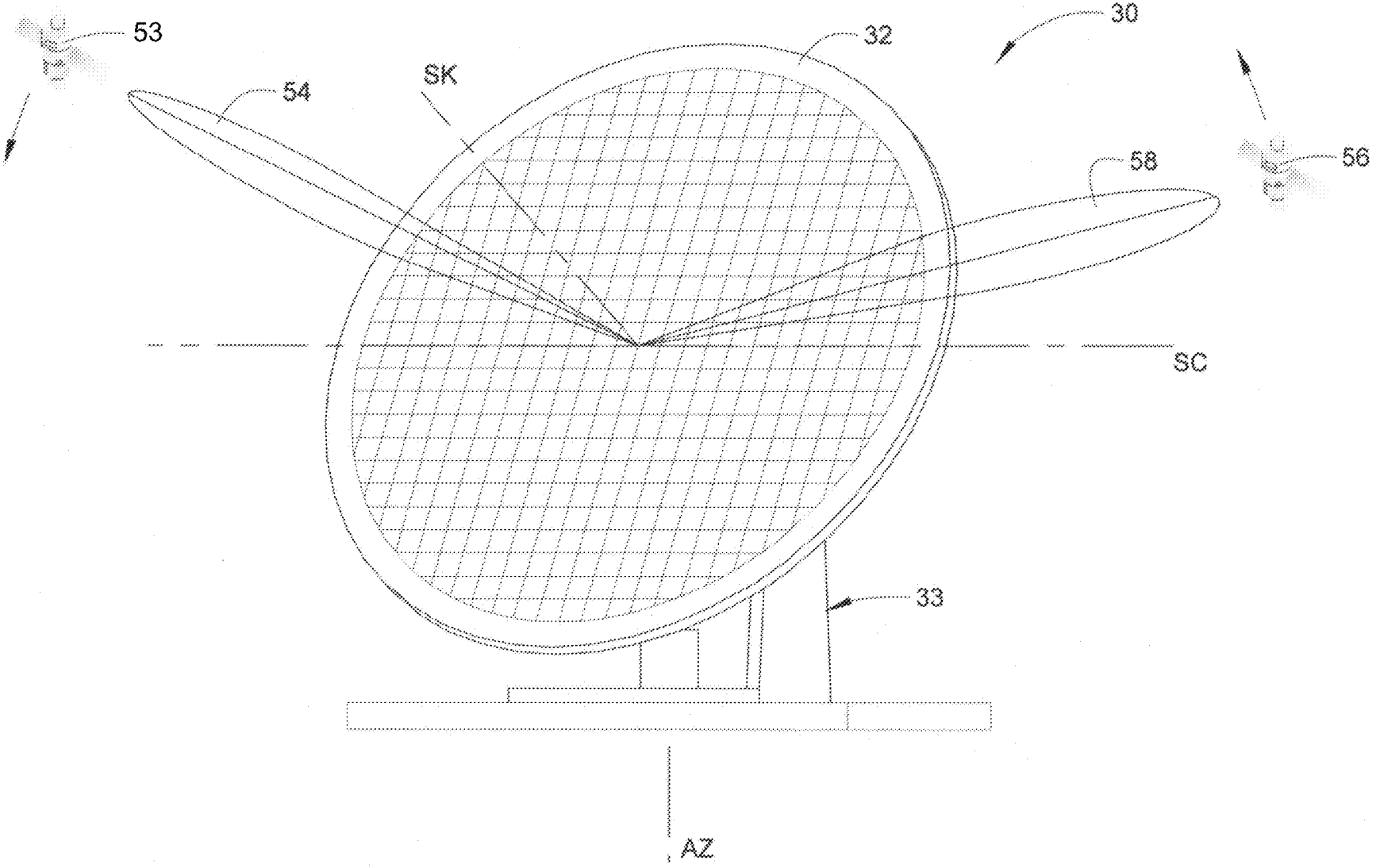
FIG. 1 is a front view of an exemplary antenna system with a one-dimensional active electronically scanned array (AESA) mounted on a two-axes tracking pedestal about a skew axis in accordance with various aspects of the present invention, the tracking pedestal having an azimuth axis and a roll axis.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Various aspects of the present invention are directed to hybrid antenna systems that are configured to facilitate simultaneous multibeam operation with two satellites that, among other things, facilitates a soft handoff between satellites. The hybrid antenna systems of the present invention include a one-dimensional active electronically scanned array (AESA) rotationally mounted on tracking pedestals about a skew axis (SK). Allowing the AESA to rotate about the skew axis, in addition to the known positioning capabilities of the tracking pedestals, provides an additional degree of freedom over otherwise conventional pedestals, which in turn allows rotation of the AESA relative to the pedestal about a skew axis.

In particular, the antenna systems of the present invention utilize rotation of the AESA about the skew axis SK, which is orthogonal to the plane of the AESA. By allowing the AESA to rotate with respect to the antenna pedestal, regardless of whether a one-, two- or three-axis pedestal is used, the present invention provides an additional degree of freedom to more accurately track and establish communications with a rising satellite while tracking and maintaining communications with a descending satellite. Such additional degree of freedom allows ready and precise alignment of a scan plane and scan axis of the AESA with both satellites regardless of their elevation angle. In addition, since the AESA may be rotated about its skew axis to maintain alignment between rising and descending satellites, the present invention allows for tracking of two satellites at higher elevation angles, even when at differing elevation angles, and regardless of whether the satellites are in intraplanar or interplanar orbits.

One will also appreciate that the additional degree of freedom may also allow ready and precise alignment of the scan plane and scan axis of the AESA with two widely-separated GEO satellites, for example, two GEO satellites positioned more than 10° apart from one another. Accordingly, the antenna systems of the present invention may obviate the need for a separate antenna or a two-dimensional scanning array for simultaneously tracking each satellite.

The AESA is a type of phased array antenna in which the beam of radio waves can be electronically steered to point in different directions without moving the antenna. As the AESA is one-dimensional, it is configured to scan throughout a scanning plane, which plane generally extends along a scan axis (SC) of the AESA orthogonally to the planar surface of the AESA. For example, the scanning plane may be defined by the intersecting skew and scan axes (see, e.g., the intersecting SK and SC axes in FIG. 1).

Turning now to the drawings, wherein like components are designated by like reference numerals throughout the various figures, FIG. 1 shows an antenna system 30 configured to facilitate a soft hand-off between two satellites. In various embodiments, the antenna system includes a one-dimensional AESA 32 rotationally mounted on a two-axes tracking pedestal 33 about a skew axis (SK).

Figure 2:
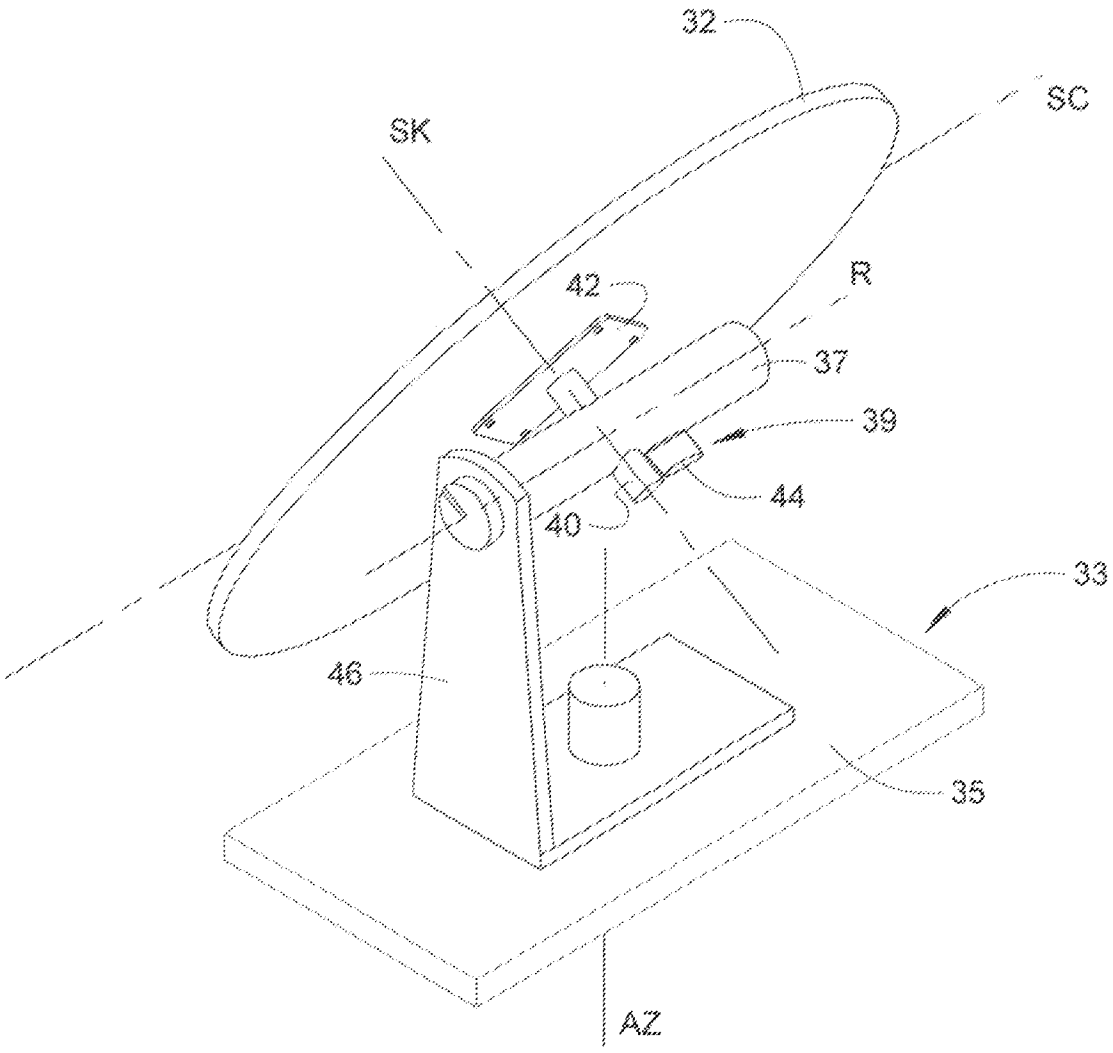
FIG. 2 is a rear view of the antenna system of FIG. 1, the skew axis being shown relative to the azimuth and roll axes of the tracking pedestal.

Generally, tracking pedestal 33 includes a base 35 and an antenna support 37 that is movably mounted with respect to the base, as shown in FIG. 2. The antenna support, in turn, supports the AESA for rotational movement about skew axis SK. One will appreciate that the base may be mounted on ground or other stationary structure, or in the case of a mobile terminal, the base may be mounted on a ground vehicle.

As illustrated in FIG. 2, the AESA is rotationally mounted on the antenna support by a skew positioner 39 for aligning the scanning plane with the first and second satellites to facilitate the soft hand-off between the first and second satellites.

Skew positioner 39 may include a spindle 40 that extends into or through the antenna support 37. The spindle may be mounted on the rear side of the AESA by a mounting plate 42 or other suitable hardware. One will appreciate that the skew positioner may include other suitable means to rotationally or pivotably mount the AESA with respect to the antenna support.

In order to effect rotation of AESA 32 with respect to antenna support 37, the Skew positioner 39 also includes an actuator 44 to drive spindle 40 for rotational or pivotal movement with respect to the antenna support. One will appreciate that the actuator may be an electric motor or other suitable driver that is operably engaged with the spindle by belt, gearing or other suitable means to rotate the spindle (and AESA) with respect to the antenna support.

With continued reference to FIG. 2, the two-axes tracking pedestal 33 may have an azimuth axis (AZ) and a roll axis (R). Accordingly, the tracking pedestal may have an azimuth frame 46 that is rotatably mounted on base 35 to rotate about the azimuth axis AZ. And antenna support 37 may be pivotably mounted on the azimuth frame to pivot about roll axis R.

Figure 3:
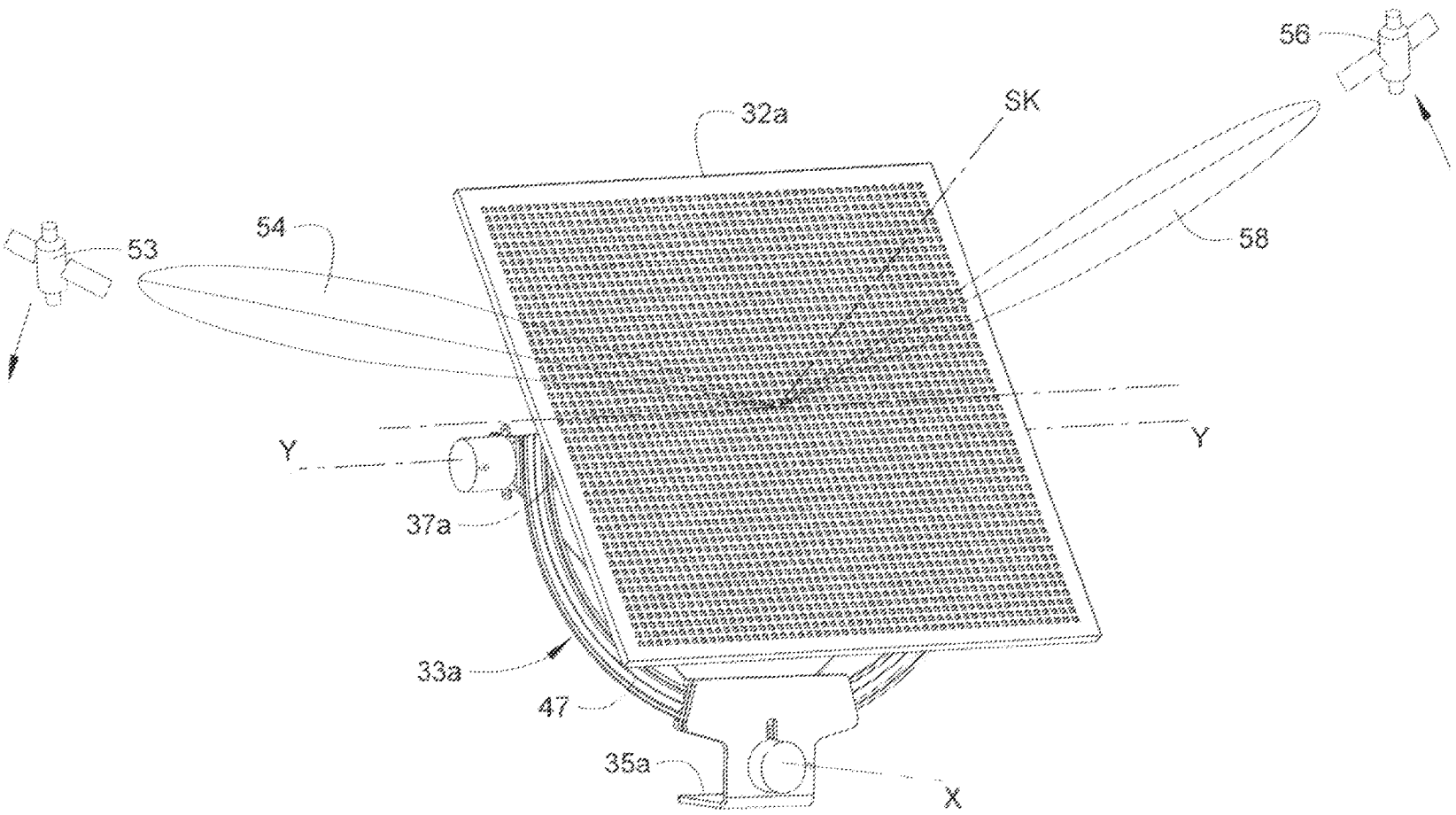
FIG. 3 is a front view of another exemplary antenna system with an AESA mounted on a two-axes tracking pedestal about a skew axis in accordance with various aspects of the present invention, the tracking pedestal having an X axis and a Y axis.
Figure 4:
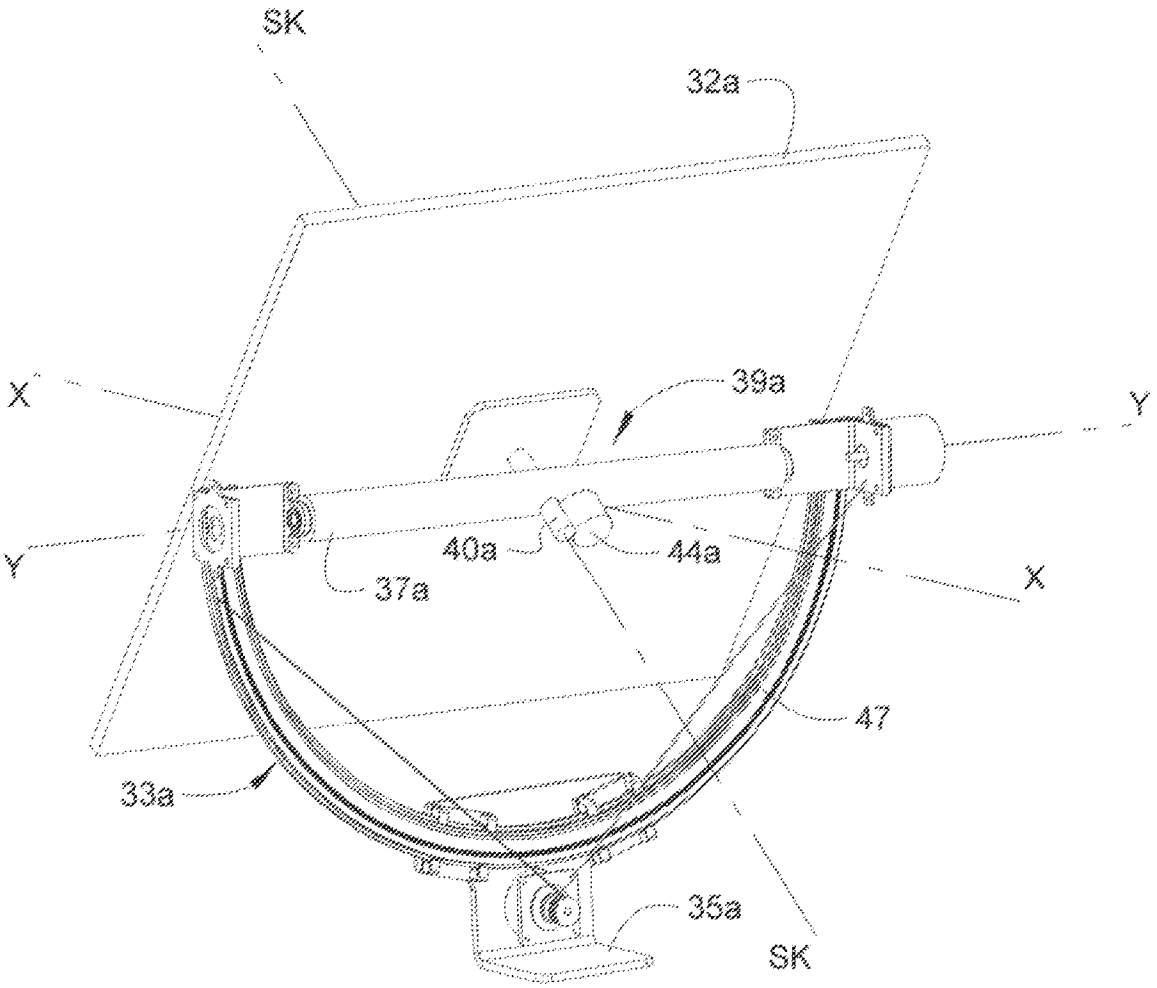
FIG. 4 is a rear view of the antenna system of FIG. 3, the skew axis being shown relative to the X and Y axes of the tracking pedestal.

Alternatively, the two-axes tracking pedestal may take the form of an otherwise conventional XY antenna mount. For example, in various embodiments, a two-axes tracking pedestal 33*a* may have an X axis and a Y axis as shown in FIG. 3 and FIG. 4. In such embodiments, a primary mount 47 is pivotally mounted on base 35*a* to pivot about the X axis, which extends substantially horizontally with respect to the ground. And a secondary mount, that is, antenna support 37*a* is pivotally mounted on the primary mount to pivot about the Y axis, which extends orthogonally to the X axis and also extends substantially horizontally with respect to the ground.

Like the above-described embodiments, AESA 32*a* is rotationally mounted on antenna support 37*a* by a skew positioner 39*a* such that the AESA can rotate about skew axis SK, as shown in FIG. 3 and FIG. 4. Allowing the AESA to rotate about skew axis SK, in addition to the known positioning capabilities of XY antenna pedestals, provides an additional degree of freedom over otherwise conventional XY antenna pedestals.

Figure 5:
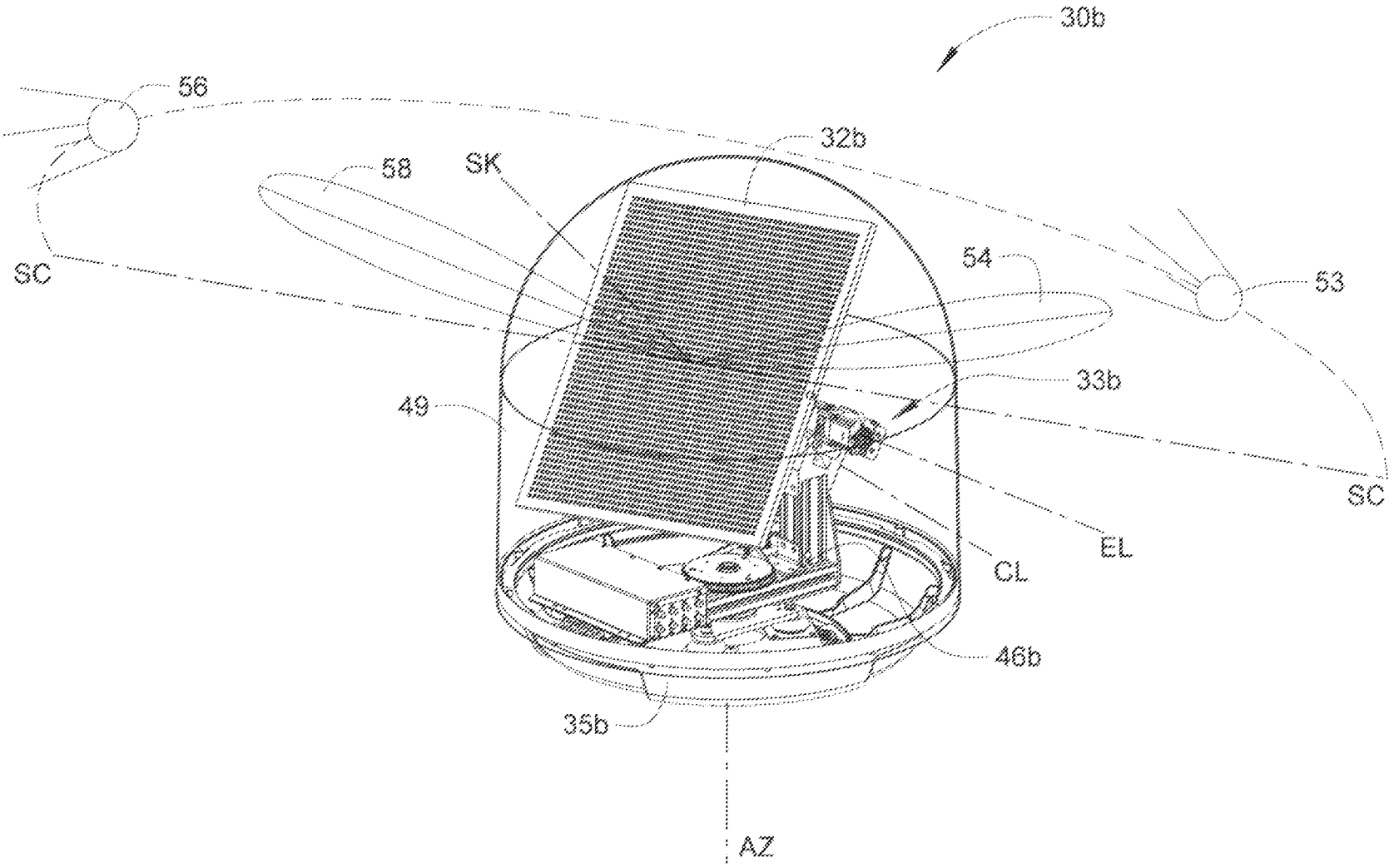
FIG. 5 is a front view of another exemplary antenna system with an AESA mounted on a three-axes tracking pedestal about a skew axis in accordance with various aspects of the present invention, the tracking pedestal having an azimuth axis, an elevation axis, and a cross-level axis.
Figure 6:
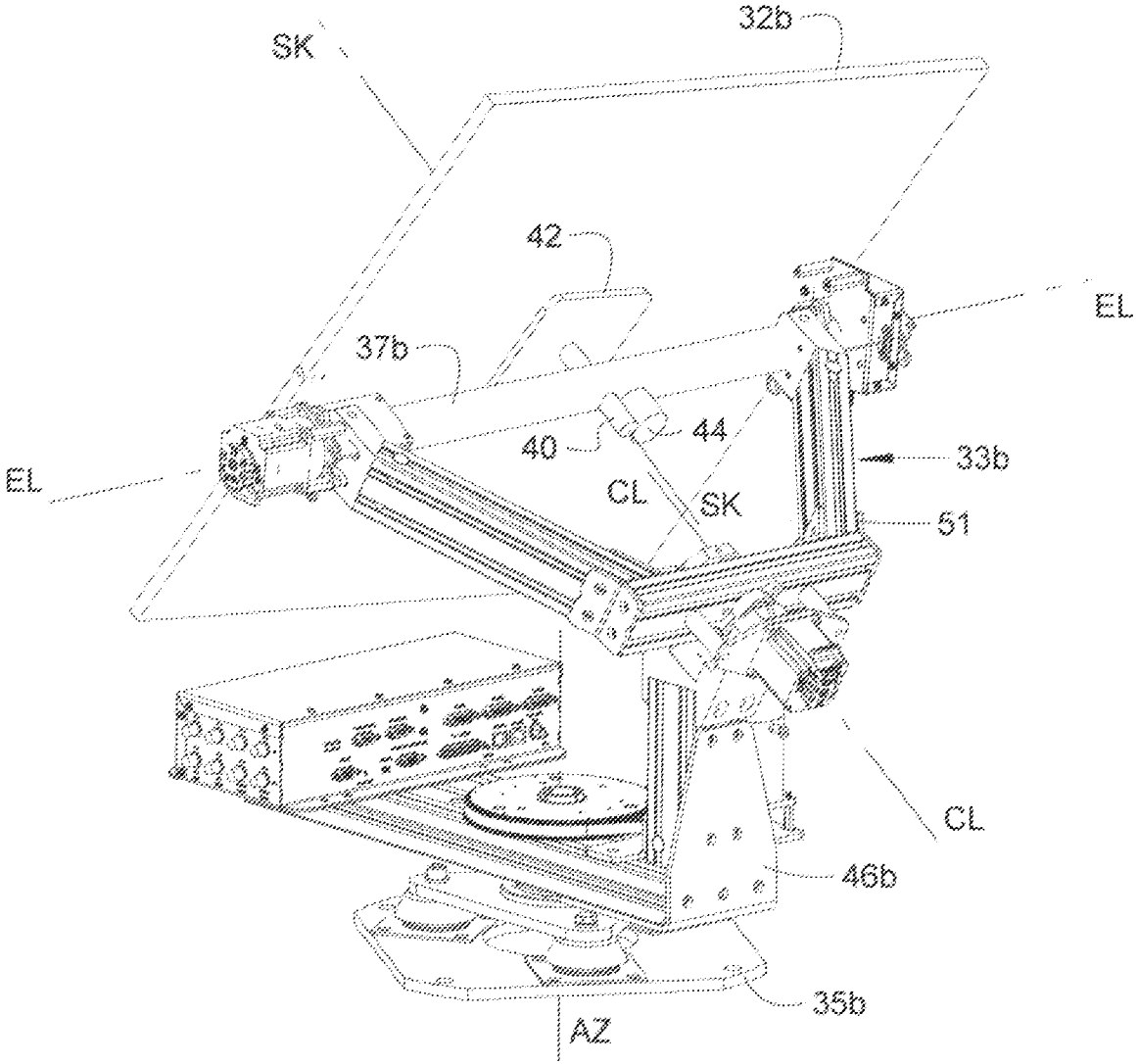
FIG. 6 is a rear view of the antenna system of FIG. 5, the skew axis being shown relative to the azimuth, elevation and cross-level axes of the tracking pedestal.

Turning to FIG. 5 and FIG. 6, in various embodiments, antenna system 30*b* may include a one-dimensional AESA 32*b* mounted on a three-axes tracking pedestal 33*b* about skew axis SK. One will appreciate that three-axes tracking pedestals are particularly well suited for maritime applications. Generally, a three-axes tracking pedestal allows movement of an antenna about an azimuth axis (AZ), a cross-level axis (CL), and an elevation axis (EL). In various aspects, the three-axes pedestal shown in FIG. 5 is similar to those shown in U.S. Pat. Nos. 8,542,156, 9,000,995, 9,466,889 and 9,882,261, the entire contents of which patents are incorporated herein for all purposes by this reference.

Tracking pedestal 33*b* includes a base 35*b* that may be mounted to a ship mast platform or other suitable portion of a vessel having a satellite communication terminal. The tracking pedestal, and AESA 32*b* supported thereon, may be mounted within a radome 49 as shown in FIG. 5. The tracking pedestal generally includes an azimuth frame 46*b* rotatably mounted on the base to rotate about azimuth axis AZ, a cross-level frame 51 (see FIG. 6) pivotally mounted on the azimuth frame to pivot about cross-level axis CL, and an elevation frame (i.e., antenna support 37*b*) that is pivotally mounted on the cross-level frame 51 to pivot about elevation axis EL. The elevation frame supports AESA 32*b* such that the AESA can freely move about the azimuth, cross-level and elevation axes (AZ, CL and EL) in an otherwise conventional fashion.

Like the above-described embodiments, AESA 32*b* is rotationally mounted on antenna support 37*a* by a skew positioner such that the AESA can rotate about skew axis SK, as shown in FIG. 5 and FIG. 6. Allowing the AESA to rotate about skew axis SK, in addition to the known positioning capabilities of three-axes pedestals, provides an additional degree of freedom over otherwise conventional three-axes pedestals.

Figure 7:
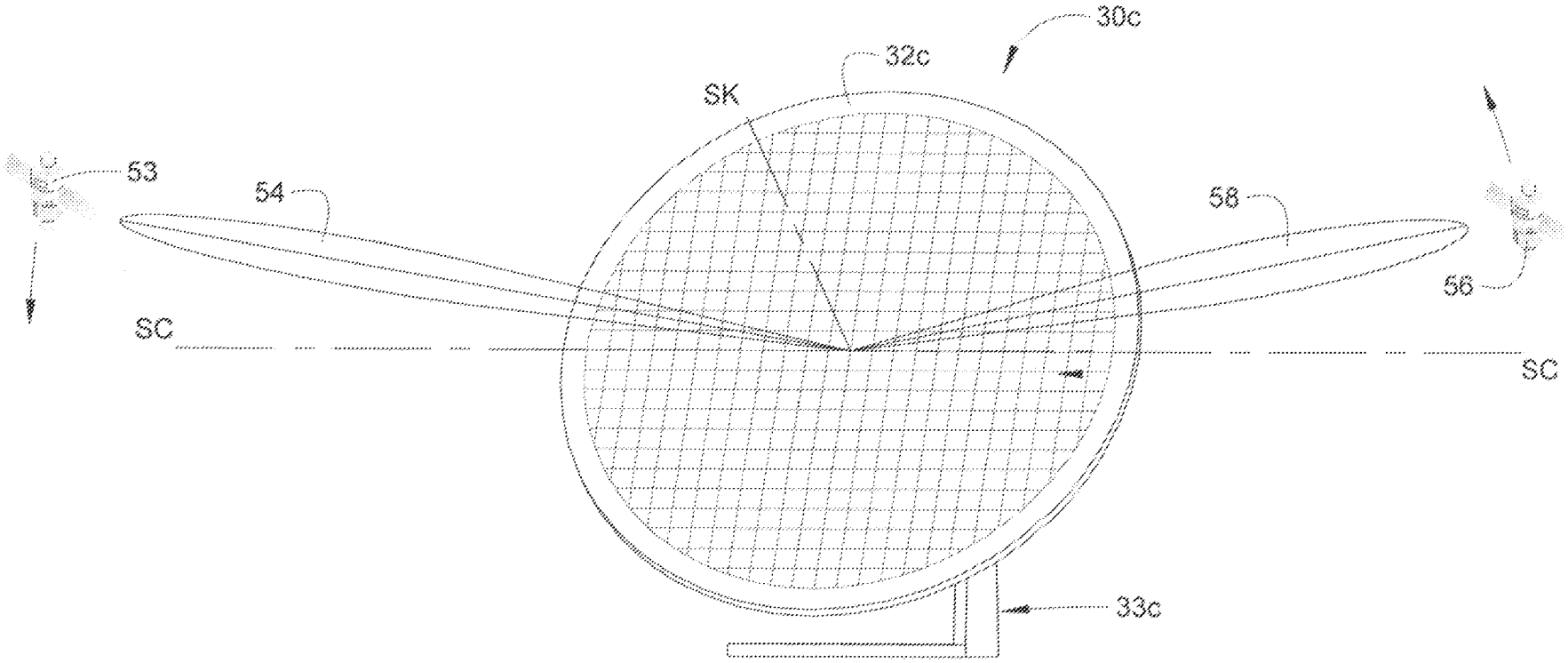
FIG. 7 is a front view of another exemplary antenna system with an AESA mounted on a one-axis tracking pedestal about a skew axis in accordance with various aspects of the present invention, the tracking pedestal having a declination axis.
Figure 8:
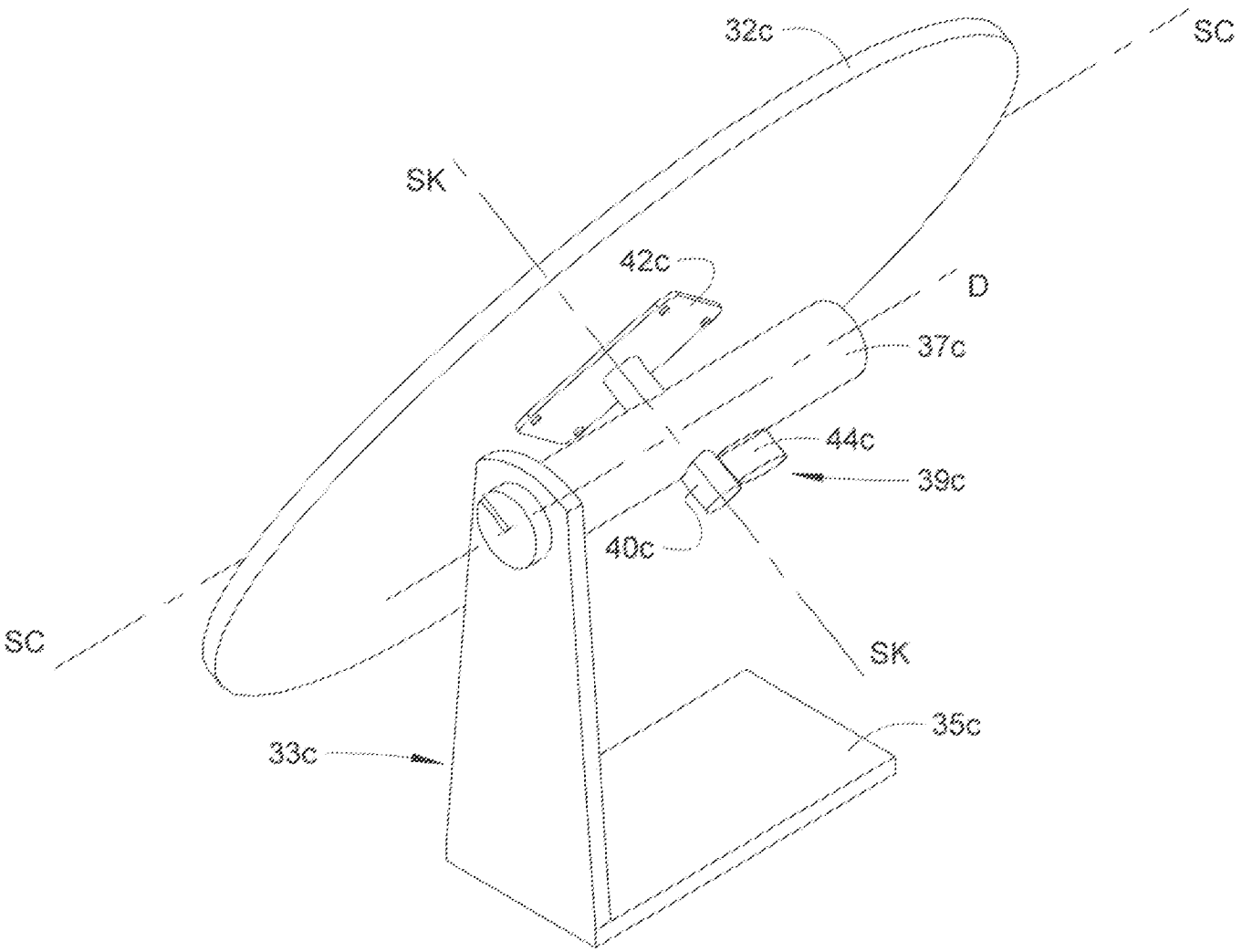
FIG. 8 is a rear view of the antenna system of FIG. 7, the skew axis being shown relative to the declination axis of the tracking pedestal.

Turning now to FIG. 7, in various embodiments, antenna system 30*c* may include a one-dimensional AESA 32*c* mounted on a one-axes tracking pedestal 33*c* about skew axis SK. As shown in FIG. 8, tracking pedestal 33*c* includes a base 35*c* and an antenna support 37*c* that is pivotally mounted with respect to the base about a declination axis (D). Unlike conventional polar mounts, antenna support 37*c*, supports AESA 32*c* for rotational movement about skew axis SK.

As shown in FIG. 8, the AESA is rotationally mounted on the antenna support by a skew positioner 39*c* for aligning the scanning plane with the first and second satellites to facilitate the soft hand-off between the first and second satellites. Like the embodiments described above, the skew positioner may include a spindle 40*c* that extends into or through the antenna support 37*c*. The spindle may be mounted on the rear side of the AESA by a mounting plate 42*c* or other suitable hardware. On will appreciate that the skew positioner may include other suitable means to rotationally or pivotably mount the AESA with respect to the antenna support.

In order to effect rotation of AESA 32*c* with respect to antenna support 37*c*, the Skew positioner 39*c* includes an actuator 44*c* to drive spindle 40*c* for rotational or pivotal movement with respect to the antenna support. Again, one will appreciate that the actuator may be an electric motor or other suitable driver that is operably engaged with the spindle by belt, gearing or other suitable means to rotate the spindle (and AESA) with respect to the antenna support.

In operation and use, tracking pedestal may be operated to direct the AESA toward a point between rising and descending satellites in an otherwise conventional manner. For example, and with reference to FIG. 1 and FIG. 2, while tracking pedestal 33 is being controlled about the azimuth axis AZ and the roll axis R to track and maintain communications with first descending satellite 53 via a first beam 54, the tracking pedestal may be further controlled to direct the skew axis SK of AESA 32 to a point between first descending satellite 53 and a second rising satellite 56. As this is done, AESA 32 may be controlled to rotate about skew axis SK such that scan axis SC is aligned with both satellites, and the AESA can establish communications with the rising satellite 56 via a second beam 58. Further control of the tracking pedestal about the azimuth and roll axes can maintain the skew axis SK to be continually directed between the two satellites, and skew positioner 39 can rotate the AESA about the skew axis SK such that the scan axis SC continues to be aligned with the two satellites. Such rotation of the AESA about the skew axis provides additional time during which first and second beams 54 and 58 can remain locked on their respective satellites, thus providing additional time to ensure a proper soft handoff.

Similarly, and with reference to FIG. 3, tracking pedestal 33*a* may be controlled about its X and Y axes to track first satellite 53 and direct the skew axis SK of AESA 32*a* to a point between first and second satellites 53 and 56. As this is done, the AESA may be controlled to rotate about skew axis SK such that scan axis SC is aligned with, and is continued to be aligned with both satellites until a proper soft handoff is achieved. And with reference to FIG. 5 and FIG. 7, tracking pedestals 33*b* and 33*c* may be similarly controlled about their respective axes, and AESAs 32*b* and 32*c* may be rotated about their respect skew axes SK such that their scan axes are aligned with, and are continued to be aligned with both satellites until a proper soft handoff is achieved. One will appreciate that each AESA may be rotated about its respective skew axis to maintain alignment with both descending and rising satellites, regardless of whether the satellites have intraplanar or interplanar orbits, and regardless of the elevational angles of the satellites.

One will appreciate that the antenna systems of the present invention are configured for simultaneous multibeam operation that may extend beyond soft handoffs. As noted above, the simultaneous multibeam operation may include communications with two widely separated GEO satellites. In such cases, the skew abled AESA may allow an earth terminal to track and maintain communications with two GEO satellites that are separated by, for example, 40°. The skew abled AESA may allow the earth terminal to communicate with the first GEO satellite to receive a TV broadcast signal, while simultaneously allowing the earth terminal to track and communicate with the second GEO satellite for internet connectivity. As opposed to the momentary simultaneous multibeam operation of a soft handoff, the skew abled AESA may allow prolonged simultaneous multibeam operation with two satellites, thereby obviating the need for multiple tracking antenna and/or two-dimensional scanning arrays.

In many respects, various modified features of the various figures resemble those of preceding features and the same reference numerals followed by subscripts "a", "b" and "c" designate corresponding parts.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An antenna system configured to facilitate simultaneous multibeam operation with first and second satellites at differing elevation angles, the antenna system comprising:

a pedestal including a base and a support pivotally mounted with respect to the base about a first axis;

a one-dimensional active electronically scanned array (AESA) configured to scan along a scanning plane that is perpendicular to a planar surface of the AESA, the AESA being rotatably mounted on the support about a skew axis orthogonal to the planar surface of the AESA; and a skew positioner configured to rotate the AESA about the skew axis relative to the pedestal for aligning and maintaining the scanning plane with both the first and second satellites at differing elevation angles to facilitate the simultaneous multibeam operation with the first and second satellites.

2. The antenna system according to claim 1, wherein the pedestal is a three-axes pedestal and the support is an elevation frame, the pedestal further comprising:

an azimuth frame rotatably mounted on the base to rotate about an azimuth axis; and a cross-level frame pivotally mounted on the azimuth frame to pivot about a cross-level axis;

wherein the elevation frame supports the AESA and is pivotally mounted on the cross-level frame to pivot about the first axis.

3. The antenna system according to claim 2, wherein the three-axes pedestal is configured for tracking Low Earth Orbit (LEO) communications satellites.

4. The antenna system according to claim 3, wherein the base of the three-axes pedestal is configured to be mounted upon a maritime vessel.

5. The antenna system according to claim 1, wherein the pedestal is a two-axes pedestal and the support is a secondary mount, the pedestal further comprising:

a primary mount pivotally mounted on the base to pivot about an X axis;

wherein the secondary mount is pivotally mounted on the primary mount to pivot about a Y axis, the Y axis being orthogonal to the X axis.

6. The antenna system according to claim 5, wherein the two-axes pedestal is configured for tracking Low Earth Orbit (LEO) and/or Medium Earth Orbit (MEO) communications satellites.

7. The antenna system according to claim 6, wherein the base of the two-axes pedestal is configured to be mounted upon the ground.

8. The antenna system according to claim 1, wherein the pedestal is a two-axes pedestal, the pedestal further comprising:

an azimuth frame rotatably mounted on the base to rotate about an azimuth axis;

wherein the support is pivotally mounted on the azimuth frame to pivot about a roll axis, the roll axis being orthogonal to the azimuth axis.

9. The antenna system according to claim 8, wherein the two-axes pedestal is configured for tracking Low Earth Orbit (LEO) and/or Medium Earth Orbit (MEO) communications satellites.

10. The antenna system according to claim 9, wherein the base of the two-axes pedestal is configured to be mounted upon the ground.

11. The antenna system according to claim 1, wherein the pedestal is a single-axis pedestal and the first axis is a declination axis configured to adjust the declination angle of the tracking antenna, wherein the support is pivotally mounted on the base about the declination angle.

12. The antenna system according to claim 11, wherein the single-axis pedestal is configured for tracking equatorial orbit Low Earth Orbit (LEO) and/or Medium Earth Orbit (MEO) communications satellites.

13. The antenna system according to claim 12, wherein the base of the single-axis pedestal is configured to be mounted upon the ground.

14. The antenna system according to claim 1, wherein the skew positioner is configured to rotate the AESA about the skew axis for aligning the scanning plane with the first and second satellites to facilitate a soft hand-off between the first and second satellites.

15. An antenna system configured to facilitate simultaneous multibeam operation with first and second satellites, the antenna system comprising:

a pedestal including a base and a support pivotally mounted with respect to the base about a first axis;

a one-dimensional active electronically scanned array (AESA) configured to scan along a scanning plane that is perpendicular to a planar surface of the AESA, the AESA being rotatably mounted on the support about a skew axis that is orthogonal to the planar surface of the AESA; and a skew positioner configured to rotate the AESA about the skew axis for aligning the scanning plane with the first and second satellites to facilitate the simultaneous multibeam operation with the first and second satellites.

16. The antenna system according to claim 15, wherein the pedestal is a three-axes pedestal and the support is an elevation frame, the pedestal further comprising:

an azimuth frame rotatably mounted on the base to rotate about an azimuth axis; and a cross-level frame pivotally mounted on the azimuth frame to pivot about a cross-level axis;

wherein the elevation frame supports the AESA and is pivotally mounted on the cross-level frame to pivot about the first axis.

17. The antenna system according to claim 15, wherein the pedestal is a two-axes pedestal, the pedestal further comprising:

an azimuth frame rotatably mounted on the base to rotate about an azimuth axis;

wherein the support is pivotally mounted on the azimuth frame to pivot about a roll axis, the roll axis being orthogonal to the azimuth axis.

18. The antenna system according to claim 15, wherein the pedestal is a single-axis pedestal and the first axis is a declination axis configured to adjust the declination angle of the tracking antenna, wherein the support is pivotally mounted on the base about the declination angle.

19. The antenna system according to claim 15, wherein the scanning plane intersects the planar surface of the AESA along a scan axis (SC), and the scanning plane is defined by an intersection of the scan axis (SC) and the skew axis (SK).

* * * * *